US005768731A

United States Patent [19]

Do

[11] Patent Number: 5,768,731

[45] Date of Patent: Jun. 23, 1998

[54] DRYING METHOD FOR DRUM-TYPE WASHING MACHINE

[75] Inventor: Gi Hyeong Do, Changwon-si, Rep. of Korea

[73] Assignee: LG Electronics Inc., Seoul, Rep. of Korea

[21] Appl. No.: 680,875

[22] Filed: Jul. 16, 1996

[30] Foreign Application Priority Data

Aug. 25, 1995 [KR] Rep. of Korea ..... 26654/1995

[51] Int. Cl.[6] ..... D06F 33/02

[52] U.S. Cl. ..... 8/159; 68/12.06; 68/12.12; 68/23.1

[58] Field of Search ..... 8/158, 159; 68/12.06, 68/12.12, 12.14, 23.1

[56] References Cited

U.S. PATENT DOCUMENTS 4,843,671 7/1989 Hirooka et al. ..... 8/159

FOREIGN PATENT DOCUMENTS 86197 4/1991 Japan ..... 68/12.06

161775 6/1993 Japan ..... 68/12.06

*Primary Examiner*—Philip R. Coe

*Attorney, Agent, or Firm*—Morgan, Lewis & Bockius LLP

[57] ABSTRACT

A drying method for a drum-type washing machine includes the steps of: draining water from a load of laundry by maintaining a predetermined drying speed for a predetermined time in an initial drying step performed during a drying stroke of the drum-type washing machine; and sensing whether an eccentricity exists after expiration of a predetermined time and, if the eccentricity is not sensed, accelerating the drying speed to accomplish drying of the laundry. The drying method prevents a drum of the washing machine from generating a flushing noise in the case where an imbalance occurs during drying, and also prevents the laundry from becoming crumpled from sticking to the drum at the end of the drying procedure.

16 Claims, 5 Drawing Sheets

DRYING METHOD FOR DRUM-TYPE WASHING MACHINE

BACKGROUND OF THE INVENTION

1. Field of the Invention

The present invention relates to a method for controlling washing strokes and the like in a washing machine. More particularly, the present invention relates to a method for controlling a drying stroke of the washing strokes of a drum-type washing machine.

2. Discussion of the Related Art

A general drum-type washing machine, as shown in FIG. 1, includes an oscillation part 7 for generating a predetermined clock; a microcomputer 1 for controlling the overall operation of the washing machine in response to the clock from the oscillation part 7; a reset part 4 for initializing the microcomputer 1; a key input part 3 for allowing a user to selectively input instructions for the washing strokes; a display part 2 for displaying a washing condition under the control of the microcomputer 1; a speed detecting part 5 for detecting the speed of a motor 12; a buzzer driving part 6 for driving a buzzer when an error or alarm is generated by the washing machine; a static voltage part 9 for applying a predetermined voltage to the microcomputer 1; a water level sensing part 8 for sensing the amount of water fed to a drum; and a load driving part 10, including tri-arc components 10*a*, 10*b*, 10*c*, and 10*d*, for driving a water supply valve 11, a motor 12, a heater 13, and a drainage pump 14 under the control of the microcomputer 10.

The drum-type washing machine structured in this fashion performs a drying operation as illustrated in FIG. 2, which is a flowchart showing a method of carrying out a drying stroke process by sensing an eccentricity of a conventional drum-type washing machine, and in FIG. 3, which is a graph showing speed versus time with respect to the drying stroke process.

With reference to FIGS. 2 and 3, if a user finishes washing or rinsing or selects a drying stroke in step 21S, the drain pump 14 is then operated for drainage purposes. When a water-level sensing part 8 senses that there is no water in the washing tub, a washing/drying motor 12 is driven. When the motor 12 is speeded up to a predetermined speed R1 in steps 22S and 23S, the time tb until the predetermined speed R1 arrives is measured.

In the case where the measured time tb is compared with a predetermined time ta in step 24S, and time tb is determined to be larger than time ta, it is sensed that the eccentricity is large due to an unbalanced load of laundry, so that the motor 12 is stopped to re-drive the drying motor in step 25S.

In the above step 24S, if time tb is smaller than time ta, the eccentricity of the laundry is sensed to be small, so that the motor is accelerated to the drying speed in steps 26S and 27S, and maintains a predetermined period of drying time in step 28S. Then, the drying step is completed. When the drying step is completed, as illustrated in FIG. 4, the entire load of laundry sticks to the inner surface of the drum.

As described above, in accordance with the drying method of the conventional drum-type washing machine, the time required for accelerating the spinning speed to a predetermined speed at which the imbalance of the laundry is sensed, is not constant. Also, if the eccentricity is not sensed just after reaching the predetermined speed, the spinning speed is accelerated up to the drying speed. As a result, a large amount of water contained in the laundry drains at one time and thus causes a flushing noise.

Moreover, the conventional drying method has another disadvantage in that the laundry sticks to the drum after the drying step ends. This causes the laundry to become tangled and crumpled.

SUMMARY OF THE INVENTION

Accordingly, the present invention is directed to a drying method for a drum-type washing machine that substantially obviates one or more of the problems due to limitations and disadvantages of the related art.

An object of the present invention is to provide a drying method for a drum-type washing machine which can prevent the drum from generating a flushing noise upon activation of a drying step, and which can also prevent laundry from sticking to the drum and thus becoming crumpled.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a drying method for a drum-type washing machine of the present invention includes the steps of: draining water from a load of laundry by maintaining a predetermined drying speed for a predetermined time in an initial drying step performed during a drying stroke of the drum-type washing machine; and sensing whether an eccentricity exists after expiration of the predetermined time and, if the eccentricity is not sensed, accelerating the drying speed to accomplish drying of the laundry.

In another aspect, a drying method for a drum-type washing machine, the method including the steps of draining water from a load of laundry in an initial drying step performed during a drying stroke of the drum-type washing machine; comparing a reference value with a difference between a slow spinning speed and a fast spinning speed of a drum of the drum-type washing machine; and based on a result of the comparing step, controlling a spinning operation of the drum.

In a further aspect, a drying method for a drum-type washing machine, the method including the steps of draining water from a load of laundry by maintaining a predetermined drying speed for a predetermined time in an initial drying step performed during a drying stroke of the drum-type washing machine; comparing a reference value with a difference between a slow spinning speed and a fast spinning speed of a drum of the drum-type washing machine; and based on a result of the comparing step, controlling a spinning operation of the drum.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION OF PREFERRED EMBODIMENT

Reference will now be made in detail to preferred embodiments of the present invention, examples of which are illustrated in the accompanying drawings.

Figure 1:
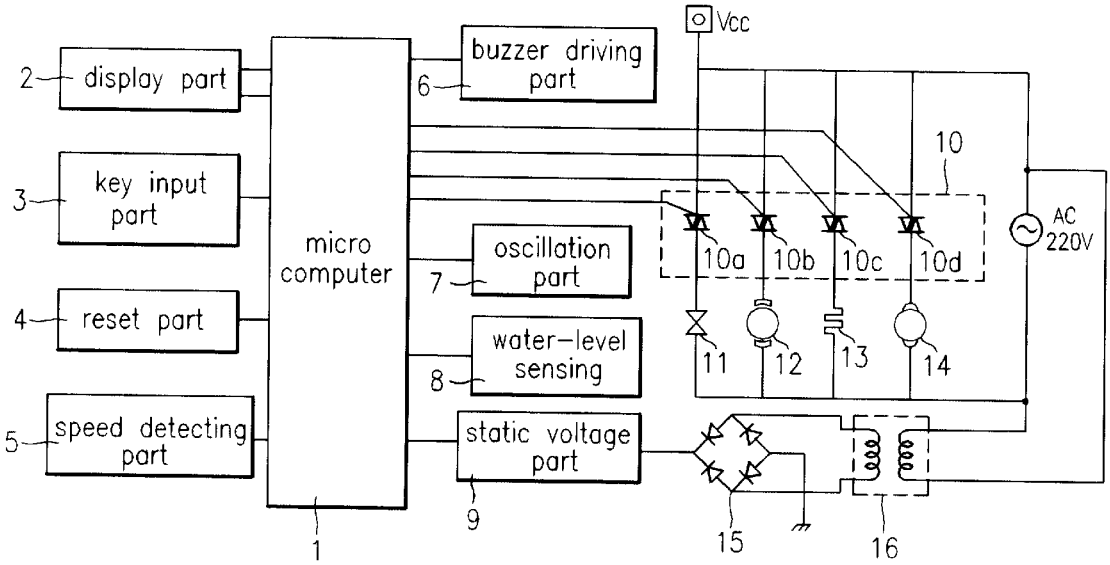
FIG.1 prior art
FIG. 1 is a block diagram showing the structure of a general drum-type washing machine.
Figure 2:
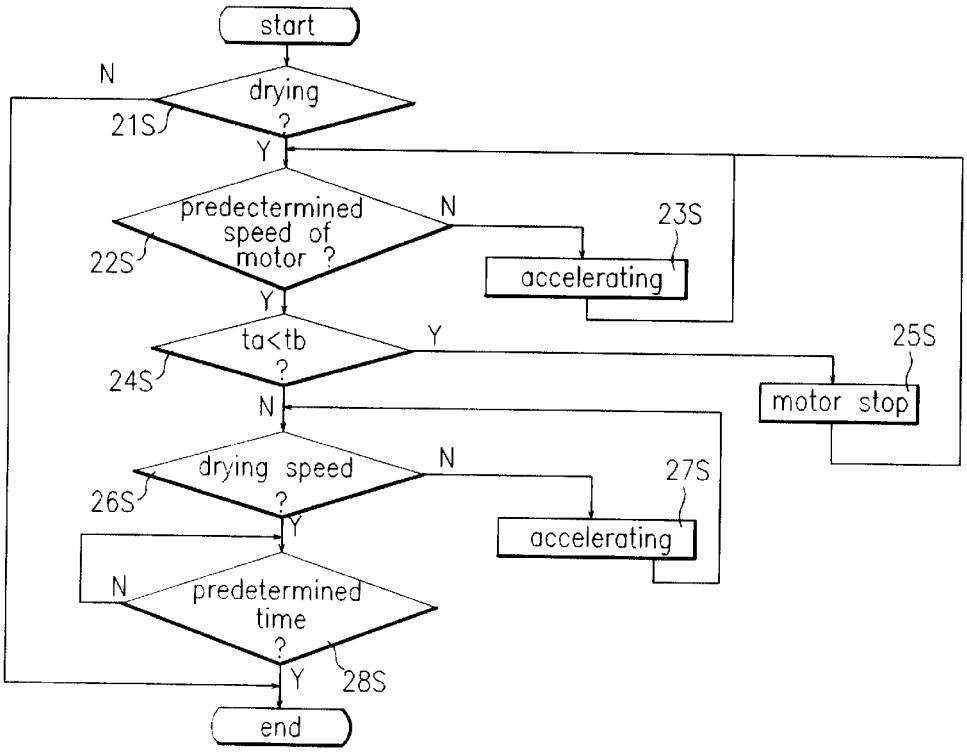
FIG.2 prior art
FIG. 2 is a flowchart showing a method of carrying out a drying stroke process by sensing an eccentricity in a conventional drum-type washing machine.
Figure 3:
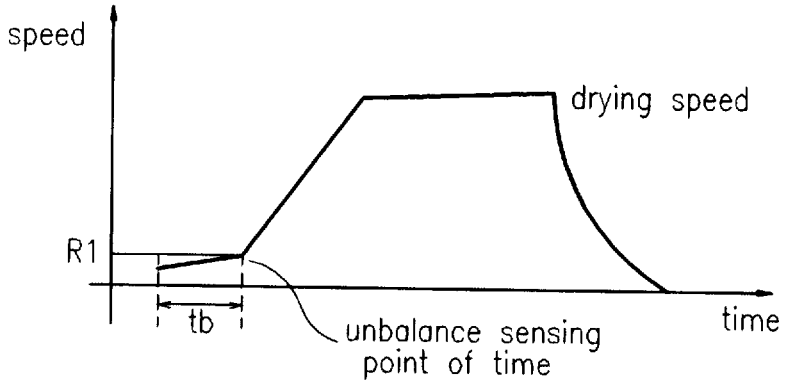
FIG.3 prior art
FIG. 3 is a graph showing characteristics of the drying stroke of FIG. 2.
Figure 4:
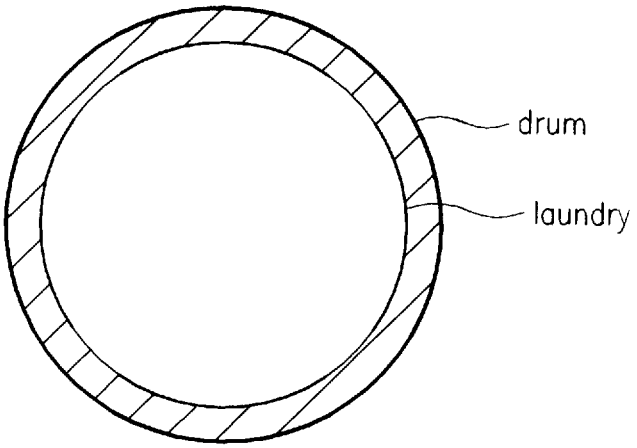
FIG.4 prior art
FIG. 4 is a cross-sectional view of an inner washing tub after completion of the drying stroke of FIG.2.
Figure 5:
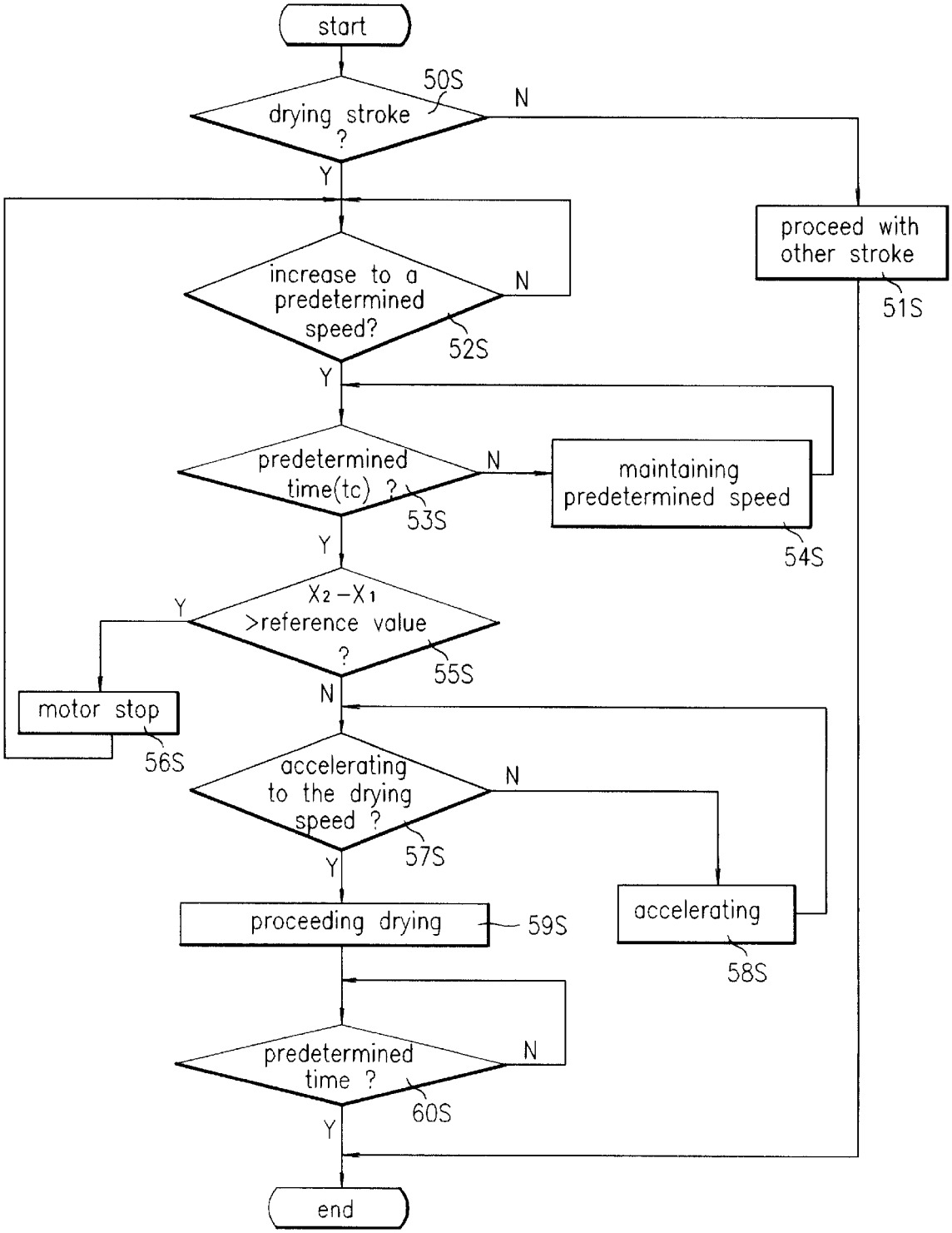
FIG. 5 is a flowchart showing a method of carrying out a drying stroke process by sensing an eccentricity in a drum washing machine according to the present invention.
Figure 6:
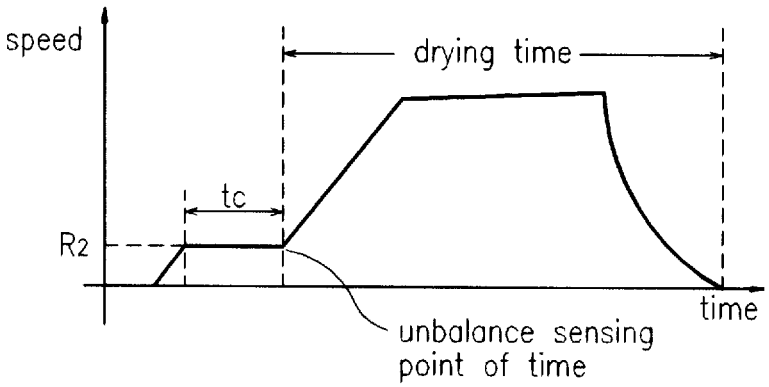
FIG. 6 is a graph showing characteristics of the drying stroke of FIG. 5.

The structure of the present invention is basically the same as that of the conventional washing machine shown in FIG. 1. The drying stroke of the drum-type washing machine of the invention will be described with reference to FIGS. 5 and 6.

During washing, after the washing and rinsing steps are completed, if a user selects a drying stroke in steps 50S and 51S, the drain pump 14 for proceeding with a drain step is operated. Then, if a water-level sensing part 8 senses that there is no water in the washing machine, a washing/drying motor 12 is driven in step 52S to accelerate the spinning speed of the washing tub to a predetermined speed R2 at which the laundry can spin with the drum without sticking to the surface of the drum.

After that step, the predetermined speed R2 is maintained in steps 53S and 54S for a predetermined time tc in order to discharge the water contained in the laundry, thereby preventing an eccentricity from being generated due to the water contained in the laundry.

When the washing tub finishes spinning at the predetermined speed R2 for time tc, the washing machine starts to sense whether there is an imbalance of the load of laundry.

Figure 7A:
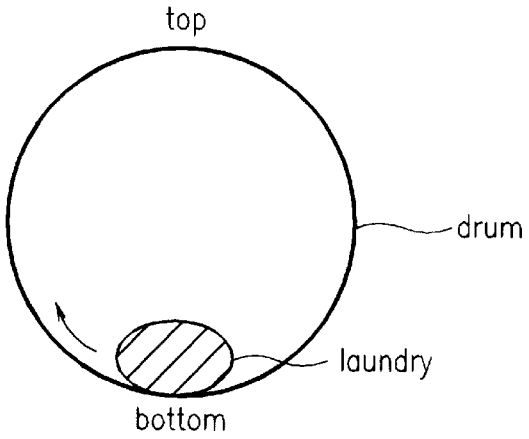
FIGS. 7A and 7B are cross-sectional views of an inner washing tub after the predetermined time (tc) of FIG. 5.
Figure 7B:
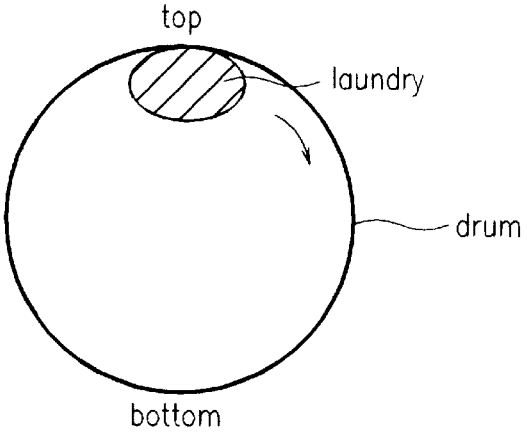

The imbalance sensing operation is performed by calculating the difference between a speed X2 at which the drum spins fastest so that the laundry is placed on the top of the drum, as in FIG. 7B, and the speed X1 at which the drum spins slowest so that the laundry is placed in the lower part of the drum, as in FIG. 7A, and then comparing the calculated difference with a reference value in step 55S. That is, the difference between X1 and X2 is compared with the reference value.

After the determining step, if the difference between X2 and X1 is larger than the reference value, the laundry is determined to be in the unbalanced state. This causes the motor 12 to be stopped in step 56S and re-processed from the starting step of the drying operation in step 52S.

If the difference between X2 and X1 is smaller than the reference value in the above step 55S, the laundry is determined to be in the balanced state. In this case, the speed of the motor 12 is accelerated to the drying speed in steps 57S and 58S (i.e., there is a loop between steps 57A and 58S whereby step 57S determines whether the drying speed has been reached and, if not, further acceleration occurs in step 58S until such speed has been reached) and the drying speed is maintained for a predetermined time in step 60S. Thus, the drying step is completed.

Figure 8:
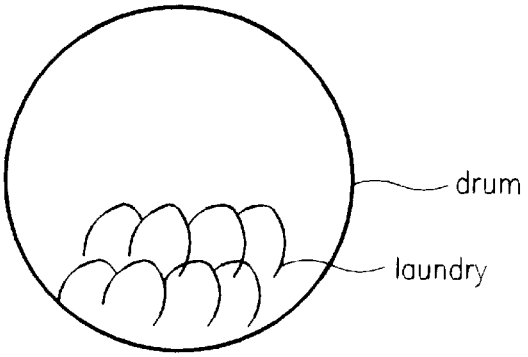
FIG. 8 is a cross-sectional view of an inner washing tub after completion of the drying stroke of the present invention.

When the drying stroke is completed using the aforementioned steps of the invention, the dried laundry does not stick to the inner surface of the drum, and also does not get tangled and crumpled by being placed on the bottom of the drum. This is illustrated, for example, in FIG. 8.

The aforementioned drying method of the invention prevents a flushing noise in the drum from being generated when the washing machine reaches the drying speed, by discharging the water contained in the laundry at the initial drying stage. This drying also prevents the laundry from being crumpled or tangled, by placing the laundry on the bottom of the drum without causing the laundry to stick to the drum.

It will be apparent to those skilled in the art that various modifications and variations can be made in the drying method of the present invention without departing from the spirit or scope of the invention. Thus, it is intended that the present invention cover the modifications and variations of this invention provided they come within the scope of the appended claims and their equivalents.

What is claimed is:

1. A drying method for a drum-type washing machine, the method comprising the steps of:

draining water from a load of laundry while maintaining a predetermined drying speed for a predetermined time in an initial drying step performed during a drying stroke of the drum-type washing machine; and sensing whether an eccentricity exists after expiration of the predetermined time and, if the eccentricity is not sensed, accelerating the drying speed to accomplish drying of the laundry.

2. The method as claimed in claim 1, wherein the sensing step comprises the step of sensing whether the eccentricity exists by comparing a reference value with a difference between a slowest spinning speed and a fastest spinning speed of a drum of the drum-type washing machine.

3. A drying method for a drum-type washing machine, the method comprising the steps of:

draining water from a load of laundry disposed in a drum of the drum-type washing machine in an initial drying step performed during a drying stroke of the drum-type washing machine;

comparing a reference value with a difference between a slow spinning speed and a fast spinning speed of the drum of the drum-type washing machine; and based on a result of the comparing step, controlling a spinning operation of the drum.

4. The method as claimed in claim 3, wherein the controlling step comprises the step of stopping spinning of the drum when the difference is greater than the reference value.

5. The method as claimed in claim 4, wherein the spinning of the drum is re-started following the stopping of the spinning of the drum.

6. The method as claimed in 3, wherein the controlling step comprises the step of accelerating spinning of the drum to a drying speed when the difference is less than the reference value.

7. The method as claimed in claim 3, wherein the comparing step is performed to sense whether an eccentricity relating to the spinning of the drum exists.

8. The method is claimed in claim 7, wherein the comparing step senses that an eccentricity exists in response to a determination that the difference is greater than the reference value.

9. The method as claimed in claim 7, wherein the comparing step senses that an eccentricity does not exist in response to a determination that the difference is less than the reference value.

10. A drying method for a drum-type washing machine, the method comprising the steps of:

draining water from a load of laundry disposed in a drum of the drum-type washing machine while maintaining a predetermined drying speed for a predetermined time in an initial drying step performed during a drying stroke of the drum-type washing machine;

comparing a reference value with a difference between a slow spinning speed and a fast spinning speed of the drum of the drum-type washing machine; and based on a result of the comparing step, controlling a spinning operation of the drum.

11. The drying method as claimed in claim 10, wherein the controlling step comprises the step of stopping spinning of the drum when the difference is greater than the reference value.

12. The method as claimed in claim 11, wherein the spinning of the drum is re-started following the stopping of the spinning of the drum.

13. The method as claimed in 10, wherein the controlling step comprises the step of accelerating spinning of the drum to a drying speed in a case where the difference is less than the reference value.

14. The method as claimed in claim 10, wherein the comparing step is performed to sense whether an eccentricity relating to the spinning of the drum exists.

15. The method is claimed in claim 14, wherein the comparing step senses that an eccentricity exists in response to a determination that the difference is greater than the reference value.

16. The method as claimed in claim 14, wherein the comparing step senses that an eccentricity does not exist in response to a determination that the difference is less than the reference value.

* * * * *